United States Patent [19]

Leavitt

[11] Patent Number: 4,769,622

[45] Date of Patent: Sep. 6, 1988

[54] REED SWITCH HAVING IMPROVED GLASS-TO-METAL SEAL

[75] Inventor: Michal W. Leavitt, Maryland Heights, Mo.

[73] Assignee: General Instrument Corporation, New York, N.Y.

[21] Appl. No.: 935,968

[22] Filed: Nov. 28, 1986

[51] Int. Cl.[4] ..... H01H 1/66; H01H 51/00

[52] U.S. Cl. ..... 335/154; 335/58; 65/DIG. 12

[58] Field of Search ..... 335/154, 151-153, 335/58, 57; 174/152 GM, 50, 61; 65/DIG. 12, 59.1, 59.5, 59.7, 59.22

[56] References Cited

U.S. PATENT DOCUMENTS 4,525,766 6/1985 Peterson ..... 357/51

FOREIGN PATENT DOCUMENTS 1078251 3/1958 Fed. Rep. of Germany .... 65/DIG. 12

5423346 12/1973 Japan ..... 65/59.22

*Primary Examiner*—E. A. Goldberg

*Assistant Examiner*—Lincoln Donovan

*Attorney, Agent, or Firm*—Kramer, Brufsky & Cifelli

[57] ABSTRACT

A novel reed switch element and method of fabricating the same comprises a ferrous alloy reed which is positioned in a glass envelope. The reed element is characterized by a layer of substantially pure titanium or chromium applied on that portion of the reed element which is in registration with the seal region of the glass envelope. Reed switch elements fabricated in this fashion display substantially improved glass-to-metal seal strength.

6 Claims, 1 Drawing Sheet

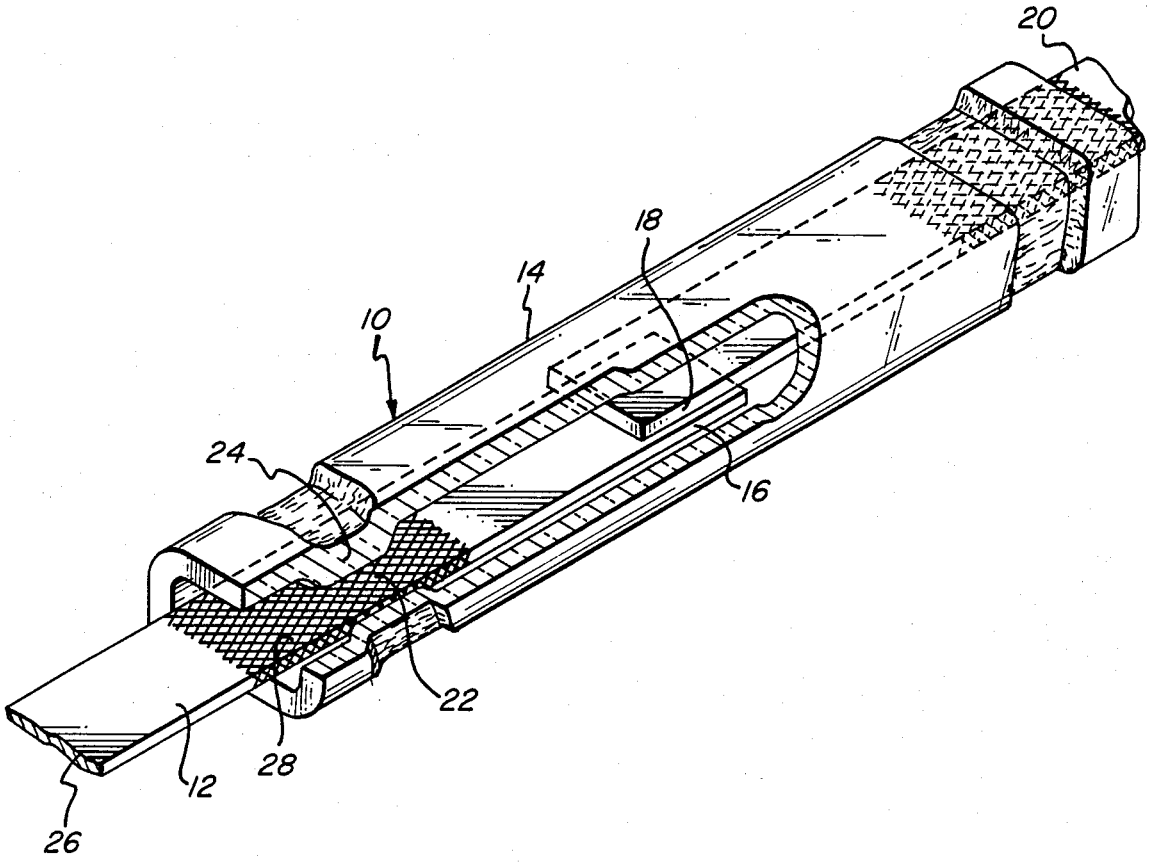
20
18
14
10
24
16
22
28
12
26

REED SWITCH HAVING IMPROVED GLASS-TO-METAL SEAL

TECHNICAL FIELD

The present invention relates to the field of reed switches and more particularly, to a new and improved reed switch having elements coated with titanium.

BACKGROUND OF THE INVENTION

Glass encapsulated reed switches are well known in the art. Present day commercial reed switches typically comprise two metal reed members and a short length of glass tubing. The reed members are approximately flat and are positioned within the glass tubing in an overlapping arrangement and have a slight offset. The glass tubing can be, for example, cylindrical or oval in cross section and is sealed directly to the ends of the metal reed members by flowing the glass locally to seal sections of the reed elements.

Reed switch configuration as well as construction techniques for assembling reed switches have been extensively developed. The prior art contains numerous examples of these techniques and includes U.S. Pat. Nos. 3,794,944, 3,866,317, 3,938,066 and 4,055,888.

The reed switches of the prior art are further characterized by a pair of glass-to-metal seals formed where the metal reed elements exit the glass envelope. Known methods for forming the required seals include those taught in U.S. Pat. No. 3,660,064. Disclosed therein is a method of construction using infrared absorbing glass envelopes which receive a pair of metal reeds at opposite open ends thereof. To form a seal, infrared radiation is applied to the ends of the envelope. The glass at the ends of the tube partially melts and flows onto the metal reeds. Only a limited portion of the glass envelope must be heated above the glass softening temperature. Apparatus disclosed in U.S. Pat. No. 3,518,411 provides means for limiting the temperature rise in the glass envelope to only the end regions of the switch.

Technology for sealing metal-to-glass in other applications has also been developed, typically for sealing metal caps to glass envelopes. U.S. Pat. No. 4,509,880 discloses a metal-glass seal characterized by a thin, multicomponent metalized layer on a glass member inserted within a tubular metal sleeve. The seal is formed by flowing tin solder in the residual gap while the glass remains unsoftened. U.S. Pat. No. 3,932,227 discloses a metal cap-to-glass envelope seal characterized by several layers of multicomponent alloys deposited on both mating surfaces. A hermetic seal is formed therebetween by compression techniques. Other examples of multicomponent, multilayer alloys used in sealing structures such as anode caps to television picture tubes, or the like, include U.S. Pat. Nos. 3,929,470, 3,803,875, 3,948,615, and 4,002,506.

U.S. Pat. No. 3,646,405 discloses a method and apparatus for providing a hermetic seal between an insulator and metal terminals. A metal lead passing into a glass envelope is sealed using a configuration which includes a titanium disc affixed to a glass annular ring at the base of the glass envelope. The metal lead is initially coated with multilayered alloys, passed through the titanium ring and is soldered thereto.

The prior art also includes U.S. Pat. No. 4,236,045 which discloses an electrical lamp wherein a filament passes into a glass envelope. A glass-to-metal seal is accomplished by a metal plug comprised of tin or lead and a second metal such as titanium. To form the seal, the metal plug is positioned at the end of the glass envelope and is heated by conventional techniques above the melting point of the solder, without softening the glass.

U.S. Pat. No. 3,959,682 discloses a hermetically sealed glass lamp provided with a current lead sealed to a lamp envelope using a primarily molybdenum foil and welding agent consisting primarily of steel and iron. The hermetic seal is accomplished by conventional spot welding techniques.

A popular technique used in the past to fabricate reed switches involves the addition of oxygen in the region where the glass to metal seal is to be effected to form an "oxide seal". However, this technique is less than perfect since it is necessary to eliminate oxygen from inside the sealed reed switch tubing in order to prevent oxidation of the electrical contact points formed by the reed elements. The introduction of oxygen into the manufacturing environment that would, ideally, be oxygen free, has been a problem in prior art fabrication techniques.

It would be advantageous to provide an improved reed switch and method for making such a switch wherein the bond between the glass tubing and the metal reed switch leads is enhanced, without the need to use an oxide seal, to provide an extremely strong and rugged seal that will withstand the external forces applied to the metal leads when the reed switch is in use. The present invention provides such an improved reed switch and method.

SUMMARY OF THE INVENTION

An object of the present invention is to provide an improved reed switch assembly wherein the bond between the glass and metal seal is extremely durable.

According to the present invention, a reed switch comprising at least two reed elements enclosed by glass includes a metallic reed having an outer surface positioned partially within an interior cavity of a glass envelope at a seal region thereof. A wetting means is affixed to substantially all of the reed outer surface that is in registration with the glass envelope seal region. The wetting means provides for reduced surface tension between the reed and the glass envelope at the glass-to-metal interface.

According to another aspect of the present invention, a method of sealing a metal reed to a glass envelope at a seal region thereof includes the steps of affixing a wetting means to a portion of the outer surface of the metal reed. The wetting means lowers the surface tension between the glass and metal. A further step includes positioning the reed within the glass and heating the glass above its softening point so as to flow the glass to the metal reed at the region thereof coated by the wetting means.

BRIEF DESCRIPTION OF THE DRAWING

The FIGURE is an illustration partially in section and partially in perspective of a portion of a reed switch element provided according to the present invention.

DETAILED DESCRIPTION OF THE INVENTION

Referring now to the FIGURE there is illustrated a reed switch 10 partially in section and partially in perspective. The reed switch is used to switch electrical signals in a variety of well-known applications. The reed switch is comprised of a reed element 12 with portions thereof extending within the interior of glass envelope 14. The reed element is of the type known in the art and can, for example, comprise a nickel-iron alloy. The reed element 12 is comprised of three sections. A switch section 16 is positioned within the envelope so to overlap the switch section 18 of an opposing element 20. A seal section 22 is positioned to be in registration with a seal section 24 of the envelope. A lead section 26 then extends outside the envelope for electrical connection.

Glass envelope 14 is a conventional reed sealing glass picked primarily for its thermal coefficient of expansion matching that of the metal in the reed switch element.

Formation of metal reed switches in the prior art usually comprise heating the glass envelope at selected portions to raise the temperature of the glass above its softening point. The glass will then flow onto the metal, firmly positioning the reed element within the envelope, and form a hermetic seal.

In prior art structures, the glass to metal bond was not particularly durable. This is evidenced by the fact that when the glass adjoining the metal leads in the seal area is crushed in prior art reed switches, the glass all crumbles off of the metal leaving a bare metal surface. In a reed switch having the structure contemplated by the present invention, a residue of glass particles adheres to the metal surface of the lead when the seal area is crushed. This result clearly establishes the improved strength of the seal provided by the present invention.

In accordance with the present invention, a glass wetting means 28 is applied to that portion of the metal reed (seal region) which is in registration with the portion of the glass envelope where the seal is to be formed. The wetting agent comprises a thin film of metal such as chrome or titanium of approximately 2000 angstroms in thickness deposited by conventional thin film vacuum deposition techniques such as sputtering, ion plating, etc. The wetting means should be deposited on substantially all of the outer surface of the seal section 22 of the metal reed 12. Before deposition of the wetting means, the metal reed surface should be prepared according to conventional techniques (for example, sputter etching) to remove any residues or oxides and assure a clean surface.

A seal is formed between the glass envelope 14 and coated metal reed 12 by raising the temperature of the glass envelope above its softening point such that the glass flows to the wetting agent coated metal and forms a hermetic seal therewith. Those skilled in the art will appreciate that various well known techniques can be used to heat the glass above its softening point, including, e.g., a $CO_2$ laser aimed at the seal area.

The reed switch element provided according to the present invention displays greater glass to metal bond strength and hermeticity over reed switch elements of the prior art. The improved strength and hermeticity offered by the reed switch of the present invention can be found to stem from the wetting means affixed to the outer surface of the reed switch element. Prior art reed switch elements had no wetting means for reducing surface tension at this critical interface. The addition of a layer of titanium dramatically reduces surface tension and is responsible for the improvements noted hereinabove. The best results were obtained with a layer of substantially pure titanium such as can be obtained from conventional sputtering processes deposited to a thickness of approximately 2000 angstroms. In addition, it should be noted that chromium deposited by sputtering, or other equivalent techniques, in thicknesses equivalent to those noted hereinabove is also effective in improving the strengths of the glass-to-metal seal, although not as effective as titanium.

Similarly, although the invention has been described with respect to a best mode embodiment thereof, those skilled in the art will note that additions, deletions or substitutions thereto can be made consistent with the spirit and scope of the invention. Those skilled in the art will note that the sealing techniques described hereinabove are not limited in application to reed switches, and are equally useful in other applications where softened glass is sealed directly to metal.

I claim:

1. A read relay comprising:

a metallic reed having a nickel-iron alloy body and an outer layer of substantially pure titanium on portions of opposite faces and adjacent side edges of said reed at a sealing section between the ends of said reed, a contact switching portion at one end of said reed not including a layer of titanium; and a glass envelope having a cavity section which encloses said contact switching portion of said metallic read and a sealing section which surrounds said sealing section of said reed and bonds to said layer of titanium at said sealing section of said reed.

2. A reed relay as set forth in claim 1 wherein said metallic reed has a generally constant, rectangular cross-section throughout the sealing section.

3. The method of forming a reed switch comprising the steps of:

coating opposite faces and adjacent side edges of a sealing portion of a metal reed with pure titanium while leaving a contact portion of the reed uncoated;

positioning a glass envelope over one end of said reed so that a sealing surface of said envelope is in registration with and surrounds the coated portion of said reed; and heating the sealing surface of said glass envelope and the coated portion of said reed above the softening temperature of the glass envelope so as to form a seal between said sealing surface of said glass envelope and the coated portion of said reed.

4. The method of claim 3 including the further step of thoroughly cleaning said sealing portion of said reed prior to coating said portion with said titanium.

5. The method of claim 4 wherein said sealing portion of said reed is thoroughly cleaned by sputter etching the surface thereof.

6. The method of claim 5 wherein said titanium is coated approximately 2000 angstroms thick.

* * * * *